US005297895A

United States Patent [19]

Johnson

[11] Patent Number: 5,297,895

[45] Date of Patent: Mar. 29, 1994

[54] METHOD AND APPARATUS FOR CONTROLLING SILT EROSION

[76] Inventor: Ron Johnson, 1295 Villa Rica Rd., Powder Springs, Ga. 30073

[21] Appl. No.: 760,367

[22] Filed: Sep. 16, 1991

[51] Int. Cl.[5] ..... E02B 11/00

[52] U.S. Cl. ..... 405/41; 405/44; 405/74; 405/37

[58] Field of Search ..... 405/73, 74, 128, 50, 405/45, 44, 43, 41, 37, 36

[56] References Cited

U.S. PATENT DOCUMENTS

| | | | |
|---|---|---|---|
| 4,260,284 | 4/1981 | Huart | 405/50 X |
| 4,572,706 | 2/1986 | Tsuruta | 405/44 X |
| 4,919,568 | 4/1990 | Hurley | 405/45 X |
| 4,988,235 | 1/1991 | Hurley | 405/50 |
| 4,991,997 | 2/1991 | Cowper | 405/73 |
| 4,998,848 | 3/1991 | Hansen | 405/128 |

*Primary Examiner*—Randolph A. Reese
*Assistant Examiner*—J. Russell McBee
*Attorney, Agent, or Firm*—Hopkins & Thomas

[57] ABSTRACT

An apparatus for use in conjunction with a silt collecting pond to prevent silt from being washed from adjacent land by rainwater comprises a base adapted to rest on the bottom of the pond and a cylindrical cage defining an upwardly open interior volume extending upwardly from the base. A conduit communicates between the interior volume of the cage and the exterior of the pond. Silt cloth is mounted about the cage and a floatable safety lid is adapted to cover the upper opening of the cage. In operation, silt bearing rainwater enters the pond and rises about the apparatus. Water passes through the silt cloth at a predetermined rate such that the water stands in the pond a sufficient time to allow silt to precipitate therefrom. When the pond has been filled with silt, a sleeve is slipped into the cage and a grated lid placed atop the sleeve so that the device thereafter provides for drainage of surface rainwater from the land.

10 Claims, 5 Drawing Sheets

METHOD AND APPARATUS FOR CONTROLLING SILT EROSION

TECHNICAL FIELD

The present invention relates to erosion control and particularly to a method and apparatus for use in the grading and leveling of land to prevent silt from being washed from the land into rivers and streams by rainwater.

BACKGROUND OF THE INVENTION

A common problem associated with construction that involves the clearing, grading, and leveling of land is the subsequent erosion of the resulting bare soil by rainwater and consequent pollution of rivers and streams by silt carried from the land with the rainwater. The problem has become so acute in some areas that regulations have been imposed upon developers requiring that silt barriers be erected to trap and contain silt that might otherwise be washed from the construction site into adjacent streams. In addition, surprisingly large volumes of silt can be washed from newly graded land such that additional soil must sometimes be brought in to replace the silt that was washed away.

One prior method of controlling silt erosion has been to erect silt barriers or fences on graded land in the path of running rainwater. Such barriers are sometimes formed from sheets of porous material called silt cloth mounted to upstanding wooden stakes. The silt cloth is adapted to pass water and to prevent passage of silt so that running water encountering the barrier passes through the cloth while silt suspended in the water is trapped behind the cloth.

Problems with these types of silt barriers have been numerous. For example, the barriers are generally flimsy and are often erected improperly such that they are easily uprooted by the force of running rainwater, thus allowing continued erosion of the land. Further, since water does not always drain from land along a single or well defined path, it can be difficult to determine the proper locations to erect the barriers. Consequently, barriers typically are erected across all potential drainage paths, which is expensive and time consuming. As a consequence, these types of silt barriers can be an ineffective and expensive method of controlling silt erosion. Also, since the barriers function as simple filters, they tend to become clogged and inefficient over time.

Another method of controlling silt erosion has been to construct a silt collecting pond at a lower elevation on land subject to erosion. An elongated cylindrical stand pipe is commonly placed in a vertical orientation within the pond and V-shaped weirs are formed around the top of the pipe. A drainage pipe in communication with the standpipe at its bottom portion extends outside the silt collecting pond. With this method, rainwater flows from higher elevations of the land and fills the silt collecting pond until the water level in the pond rises to the bottom of the V-shaped weirs. Excess water then drains through the weirs into the standpipe and out of the pond through the drainage pipe. the weirs into the standpipe and out of the pond through the drainage pipe.

With the just described method, water normally stands in the pond at or below the level of the weirs so that silt can precipitate to and collect on the bottom of the pond. Problems with this method have been that water standing in the pond tends to attract mosquitoes, algae, and, in general, forms an unsightly and unhealthy quagmire. Further, sticks and other debris tend to get caught in the weirs preventing proper drainage of water therethrough and consequently decreasing the efficiency and effectiveness of the device.

A common problem with both silt fences and collecting ponds arises when they are used along an extended sloped grade where a plurality of barriers or collecting ponds are positioned at intervals along the grade. In these situations, flowing water accumulates as it flows past each successive barrier such that at the bottom of the slope the flow can become a torrent that washes away even the best silt fences and collecting ponds. Prior art control methods have therefore proven ineffective for use on such extended slopes.

Finally, with prior art methods the silt fences and stand pipes must generally be removed and discarded after the land on which they were installed has been graded, leveled, and stabilized. In many cases, separate drainage systems must subsequently be installed to insure adequate drainage of rainwater from the land in the future.

There is, therefore, a persistent and heretofore unaddressed need for a method and apparatus for controlling silt erosion that overcomes the many problems associated with prior art silt control methodologies. It is to the provision of such a method and apparatus that the present invention is primarily directed.

SUMMARY OF THE INVENTION

Briefly described, the present invention is an apparatus for use in conjunction with a silt collecting pond to prevent silt from being washed by rainwater from adjacent land into rivers and streams. In one embodiment, the device comprises a concrete base adapted to rest on the bottom of the silt collecting pond. A cylindrical cage is mounted to the base and extends upwardly to a height substantially equal to the depth of the pond. A conduit communicates between the interior of the cage and the outside of the pond so that water within the cage can flow out of the pond through the conduit.

The exterior of the cage is covered with silt cloth chosen to pass water into the interior volume defined by the cage at a predetermined rate while preventing passage of silt into the cage. Means for releasibly mounting and tightly drawing the cloth about the cage is provided and, in one embodiment, a floatable safety lid normally covers the top of the cage to prevent children or animals from falling accidentally into the cage. The safety lid floats upwardly in response to excess water from heavy rains to permit water to flow directly into the top of the cage and out of the pond.

A concrete sleeve having an outside diameter slightly less than the inside diameter of the cage is provided. After the silt pond has filled with dirt and silt and has been graded, leveled, and stabilized, the sleeve can be inserted into the cage through its top and capped with a concrete lid bearing a drainage grate. In this way, the device of this invention also serves as a long term water drainage system after its usefulness as a silt trap has ended.

With the just described invention properly in place, silt bearing rainwater from a rain shower flows from adjacent land into the silt collecting pond. As the water level within the pond rises, water flows through the silt cloth and into the interior volume defined by the cage at a rate determined by the mesh size of the cloth. Water flowing into the cage is directed out of the pond through the drainage pipe while silt and dirt suspended in the water settles to the bottom of the pond.

In practice, the mesh size of the silt cloth, and thus the flow rate of water into the cage, is chosen to allow water to stand in the pond a sufficient time to permit silt suspended in the water to precipitate to the bottom of the pond. Eventually, substantially all of the water passes through the silt cloth and drains from the pond leaving the dry silt and dirt in the bottom of the pond until the next rainfall, when the process is repeated. Eventually, silt and dirt fills the pond to the top of the cage whereupon the sleeve is inserted into the cage and capped with the drainage grid. In this way, the silt filled pond can be leveled and stabilized with grass or the like whereupon the device of the present invention serves as a permanent rainwater drainage system.

In one configuration, a series of the devices of this invention arranged in respective silt collecting ponds along a sloping grade and each drains water to a subterranean drain pipe. In this way, water is drained to the drain pipe at each interval along the grade such that the torrents often associated with prior art methods on such slopes is eliminated and reliable silt control is achieved throughout the extent of the grade.

Thus, an improved method of controlling silt erosion is now provided wherein problems associated with prior art methods are virtually eliminated. In particular, the standing, stagnant water often associated with prior art collecting ponds and standpipes has been eliminated. With the present invention, water stands in the pond only long enough to allow precipitation of silt and the pond drains completely dry after each rain. Further there are no weirs to be clogged by sticks and other debris so that the efficiency of the present apparatus remains high even as silt levels rise in the bottom of the pond and about the cage. As the drainage area soil is stabilized and the pond fills with silt, the top surface of the silt can be grassed to stabilize the silt further and the sleeve can be installed to provide for future drainage control. The floatable safety lid, which can be removed after stabilization of the pond, is adapted to prevent children from falling accidentally into the cage and also accommodates high water levels resulting from heavy rainfall. When used on an extended sloped grade, the present invention prevents the devastating torrents at the slope bottom often associated with prior art methods. Further objects and advantages of the present invention will become more apparent upon review of the following detailed description taken in conjunction with the accompanying drawings.

DETAILED DESCRIPTION OF THE PREFERRED EMBODIMENT

Figure 1:
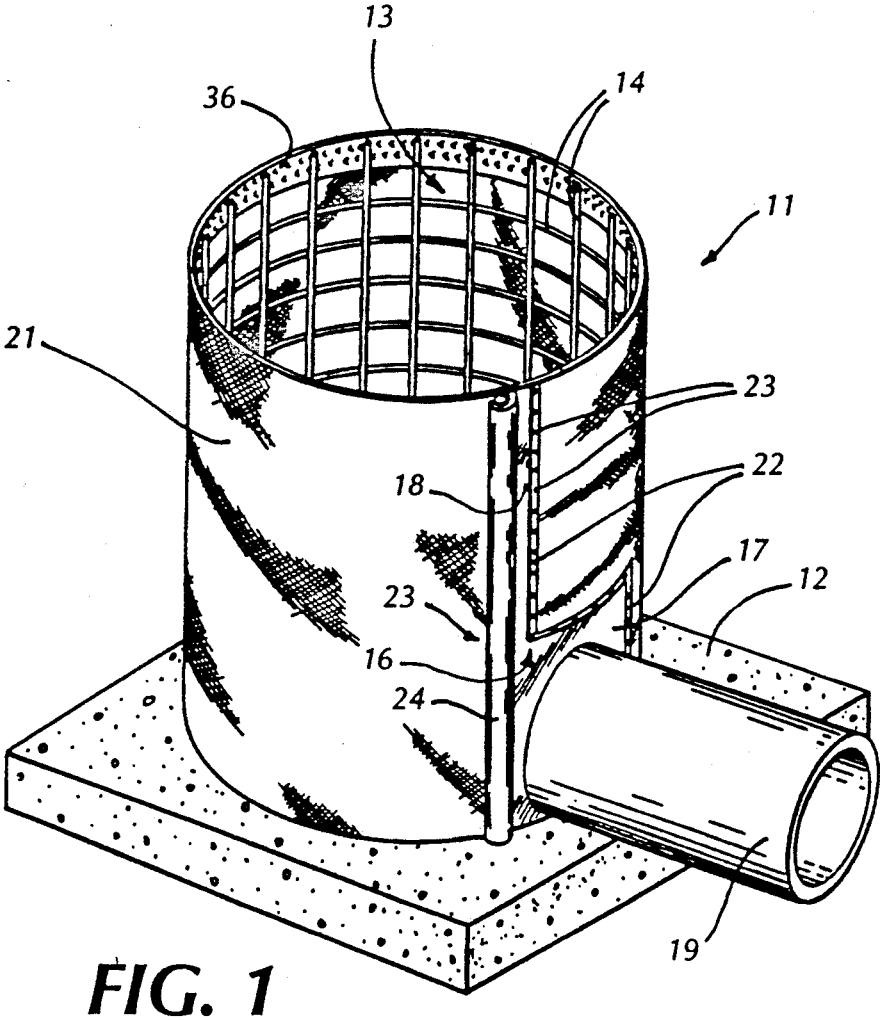
FIG. 1 is a perspective view of one embodiment of the apparatus of the present invention.

Referring now to the drawings in which like numerals refer to like parts throughout the several views, FIG. 1 illustrates an erosion control apparatus that embodies principals of the present invention in one preferred form. The apparatus 11 has a preferably concrete base member 12 to which is mounted a substantially cylindrical vertically extending open topped cage 13 formed from a plurality of interconnected rods 14. While the cage 13 is shown to be formed in the shape of an upstanding cylinder, it will be understood that other shapes of the cage such as, for example, rectangular box shaped, could be equally acceptable for purposes of this invention.

Mounted to one side of the cage 13 is a mounting plate 16 that preferably is formed from a sheet of non-corrosive metal such as stainless or galvanized steel. The mounting plate 16 is welded or otherwise attached to the cage 13 and has a wider lower portion 17 and a narrower upper portion 18 as best seen in FIG. 1. Mounted to the lower portion 17 adjacent the bottom of the cage is a discharge conduit 19. The lower portion 17 of the mounting plate has a circular opening (not shown) with a diameter corresponding substantially to the inner circumference of the discharge conduit 19. The conduit 19 is positioned to cover the opening and is welded or otherwise attached to the lower portion of the mounting plate so that the discharge conduit 19 is in communication with the interior volume defined by the cage 13.

Stretched tightly about the exterior of cage 13 is a length of silt cloth 21 adapted to pass water into the interior volume defined by the cage while preventing passage of silt into the cage. Such silt cloth is commercially available from petroleum companies such as the American Oil Company (AMOCO) and is commonly available with various mesh sizes adapted to pass water at various predetermined flow rates and to prevent passage of various size silt or dirt particles.

In the present embodiment, the particular silt cloth for a given size silt pond and anticipated drainage rate is chosen to pass water at a rate that is low enough to allow the water to stand in the silt collecting pond a sufficient time to permit silt particles to precipitate to the bottom of the pond as the water passes through the cloth into the interior volume. In this way, the silt cloth acts not as a common filter, in which case the cloth tends to be clogged by the silt, but as a controller of the egress rate of the water to allow silt precipitation to the bottom of the pond. This also insures that the pond is filled evenly with silt and dirt over time.

The silt cloth 21 is firmly attached at one end to one side of the mounting plate 16 by means of elongated attaching strips 22. Specifically, the edge of the silt cloth is sandwiched between the attaching strips 22 and the mounting plate and the attaching strips are fastened securely to the mounting plate with screws or other suitable fasteners 23. From the attaching strips, the silt cloth extends around the cage 13 to the other side of the mounting plate 16 where it is secured and drawn tightly about the cage with tensioning means 23.

Figure 4:
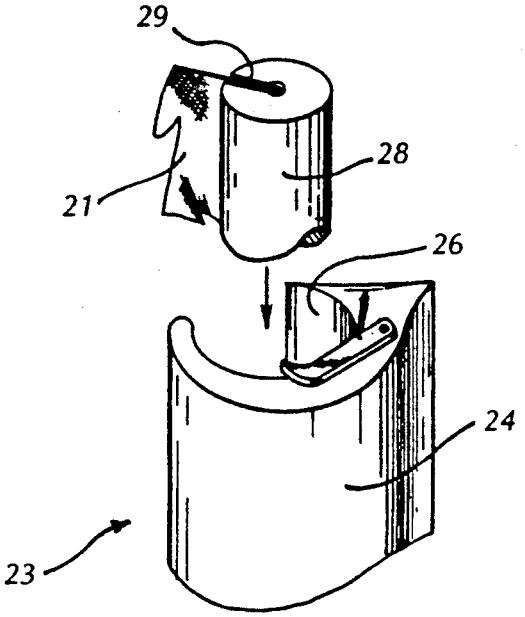
FIG. 4 is an enlarged perspective view of a portion of the silt cloth tensioning means showing placement of the tensioning bar in the central bore of the retaining means.

As seen in FIGS. 1 and 3–5, the tensioning means comprises an elongated generally arcuate retaining member 24 secured to the mounting plate with nuts 26 or other fastening means (FIG. 3) with the retaining means extending substantially longitudinally relative to the cage. The retaining member 24 is seen to define a central bore 26 and an elongated slit 27 that communicates with the bore along the length of the retaining member. A tensioning rod 28 is adapted to fit loosely into the central bore 26. The rod 28 is formed with a longitudinally extending slit 29 adapted to receive and hold an edge of the silt cloth as best seen in FIG. 4. While the figures illustrate a slit formed in the tensioning bar 28 for holding an edge of the cloth, it will be understood that other holding means such as, for example, an attaching strip could perform equally well.

Figure 5:
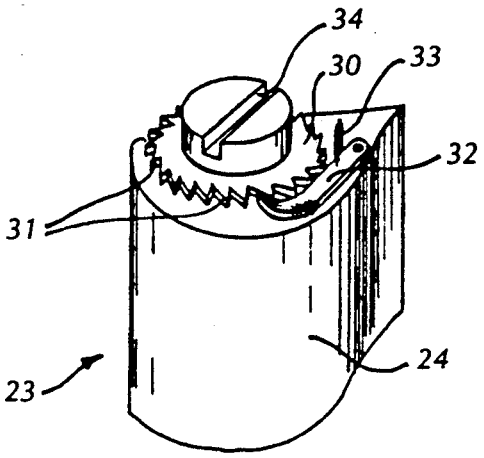
FIG. 5 is a partial perspective showing the upper portion of the tensioning means and the cooperating ratchet and pawl.

A ratchet 30 is mounted to the top portion of the tensioning rod 28 and extends radially outwardly therefrom to a plurality of ratchet teeth 31 (FIG. 5). A pawl 32 is pivotably mounted to the top of the retaining member 24 and a coil spring 33 is positioned to bias the pawl 32 into engagement with the teeth 31. In this way, rotation of the tensioning rod is permitted in a clockwise direction in FIG. 5 but is prevented in a counterclockwise direction. A diametrically extending groove 34 is formed in the top of the rod 28 to facilitate rotation of the rod 28 within the central bore 26 with a large screwdriver or other similar tool (not shown).

Figure 6:
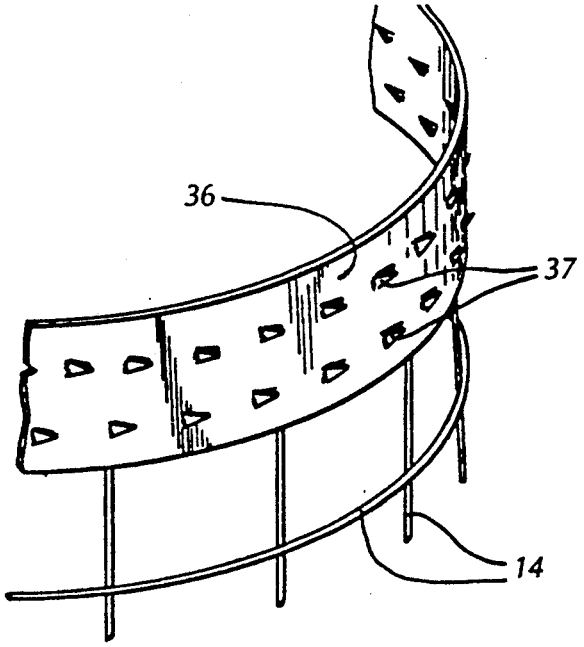
FIG. 6 is a partial perspective view of the upper portion of the cage showing the silt cloth retaining rim.

As illustrated in FIG. 6, a rim 36 is welded or otherwise secured to the upper portion of the cage 13 and extends around the outer circumference thereof. A plurality of projections or barbs 37 are formed in the rim 36 and protrude outwardly therefrom to engage and secure the upper edge of the silt cloth 21 upon its being drawn tightly about the cage.

Figure 7:
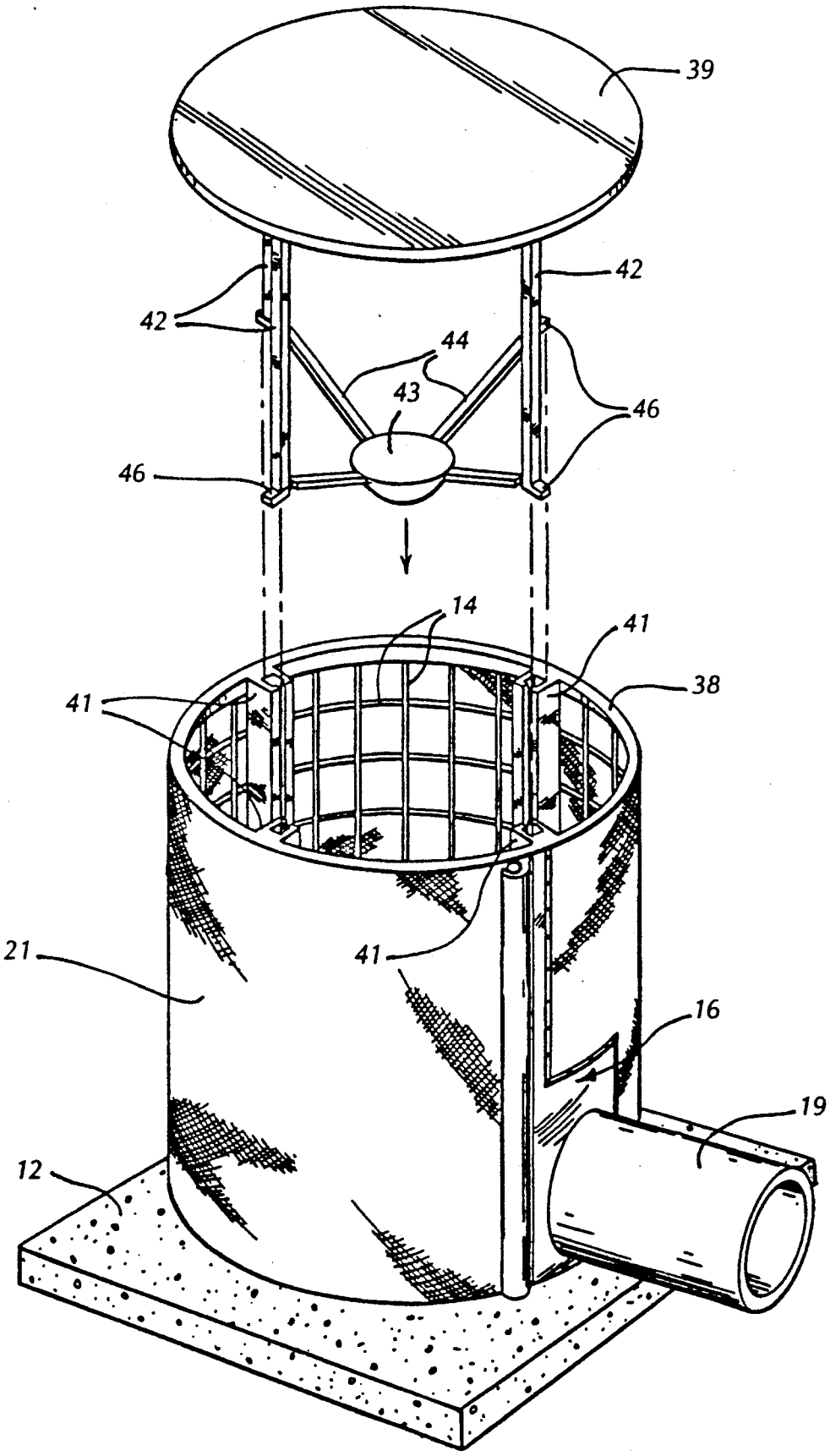
FIG. 7 is an exploded perspective view of a second embodiment of the apparatus showing a preferred embodiment of the floatable safety lid.

FIG. 7 illustrates a second embodiment of the apparatus that includes a vertically movable closure adapted to cover the top of the cage and thereby prevent children or pets from falling accidentally into the cage. In this embodiment, a metal rim 38 is mounted around the top portion of the cage and includes four vertically extending tracks 41 positioned within the cage adjacent its periphery. A lid 39 is sized to cover the upper opening defined by the cage and, in a preferred embodiment, the lid is hollow and filled with air so that it is floatable. Four elongated track followers 42 extend downwardly from the bottom of the lid 39 and are positioned to couple slidably with the tracks 41 such that the lid can be alternately raised and lowered with the track followers 42 sliding up and down respectively within the tracks 41.

A weight 43 is mounted to the end portions of four rods 44 that are in turn attached to the lower end portions of the track followers 42. Stops 46 protrude from the bottoms of the track followers 42 and extend outwardly therefrom to engage the underside of the rim 38 when the track followers 42 are fully extended to prevent the track followers and thus the lid from sliding completely out of the cage.

Figure 8:
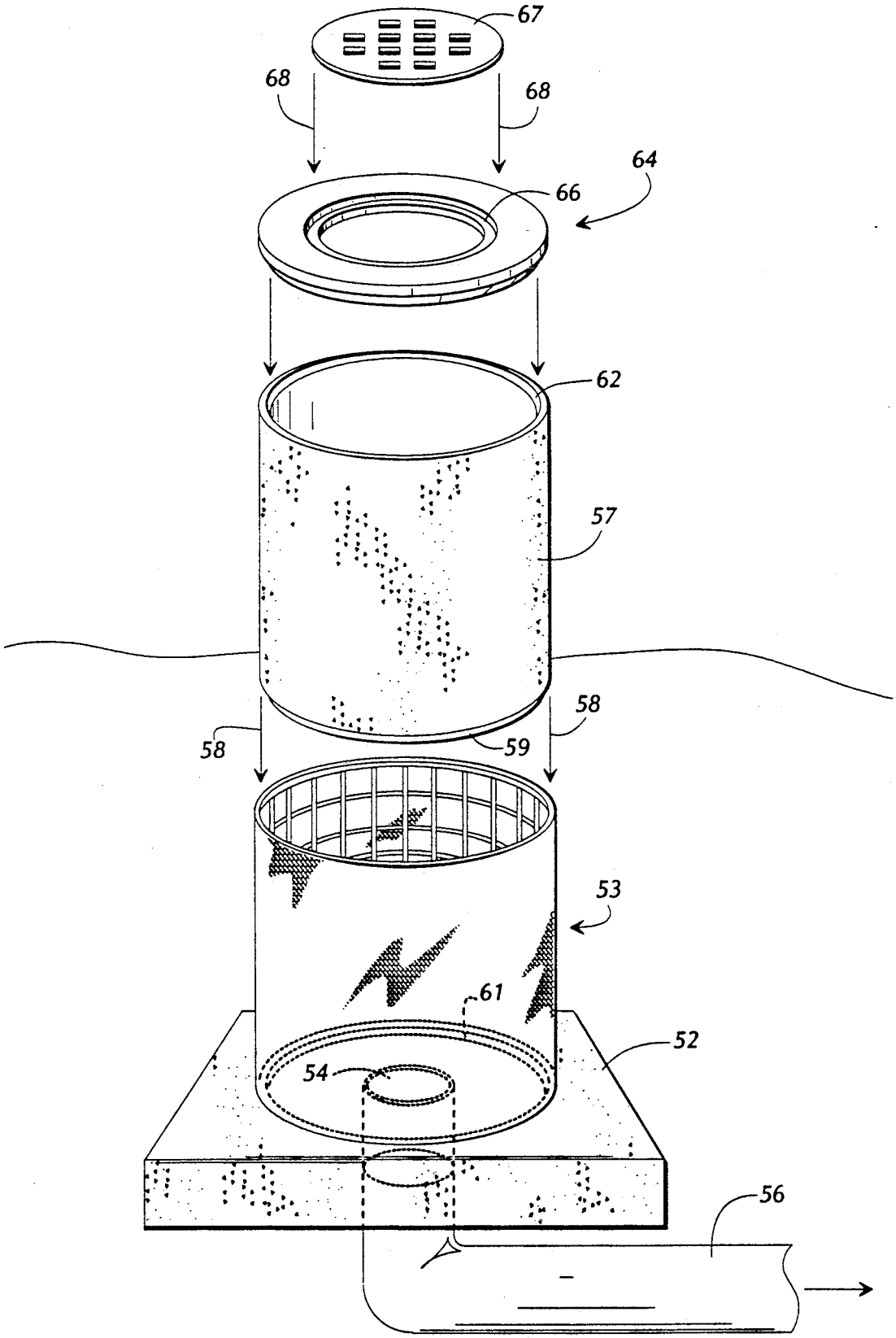
FIG. 8 is an exploded perspective view of a third embodiment of the invention showing the concrete sleeve and grated cover used to convert the silt cage into a permanent drainage system.

FIG. 8 illustrates a third embodiment of the invention wherein the device is adapted to convert to a permanent drainage system after its usefulness as a silt control device has ended. In this embodiment, the device 51 comprises a substantially rectangular preferably concrete base member 52 that rests on the bottom of a silt collecting pond. A silt cloth covered cage 53 extends upwardly from the base 52 and functions in substantially the same way as previously described to control silt erosion from adjacent land. A drain 54 is formed through the base 52 within the cage 53 and communicates with a conduit 56 that, in turn, communicates with a remote location outside the silt collecting pond.

A rigid preferably concrete sleeve 57 has a diameter slightly smaller than that of the cage 53 and is adapted to be slid into the cage through its top as indicated by arrows 58. The bottom peripheral edge of the sleeve 57 is formed with a tapered rim 59 that fits snuggly within a corresponding tapered ridge 61 formed in the base 52 when the sleeve 57 is inserted into the cage 53.

Similarly, the upper peripheral edge of the sleeve 57 is formed with a contoured rim 62 adapted to receive and conform to a corresponding lip 63 formed in a concrete lid 64. With the just described configurations of the base, sleeve, and lid, it can be seen that the sleeve 57 fits snugly and securely onto the base 52 and, likewise, the lid 64 fits snugly and securely upon the top of the sleeve 57.

The lid 64 is formed with a central opening 66 sized and configured to receive a drainage grate 67 when the grate is lowered into the opening as indicated by arrows 68. The grate 67 is preferably formed of cast iron or other heavy erosion resistant material so that it is not easily lifted from its position within the opening 66.

Figure 9A:
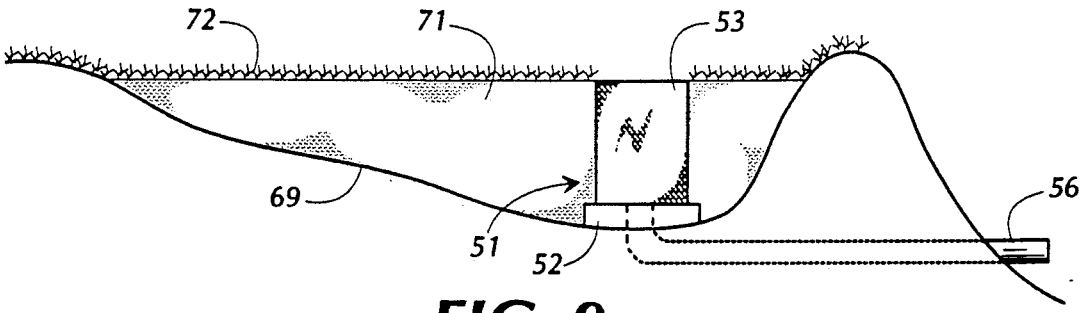
FIGS. 9*a* and 9*b* illustrate a device of FIG. 8 as it appears after the surrounding land has been graded, leveled, and stabilized.
Figure 9B:
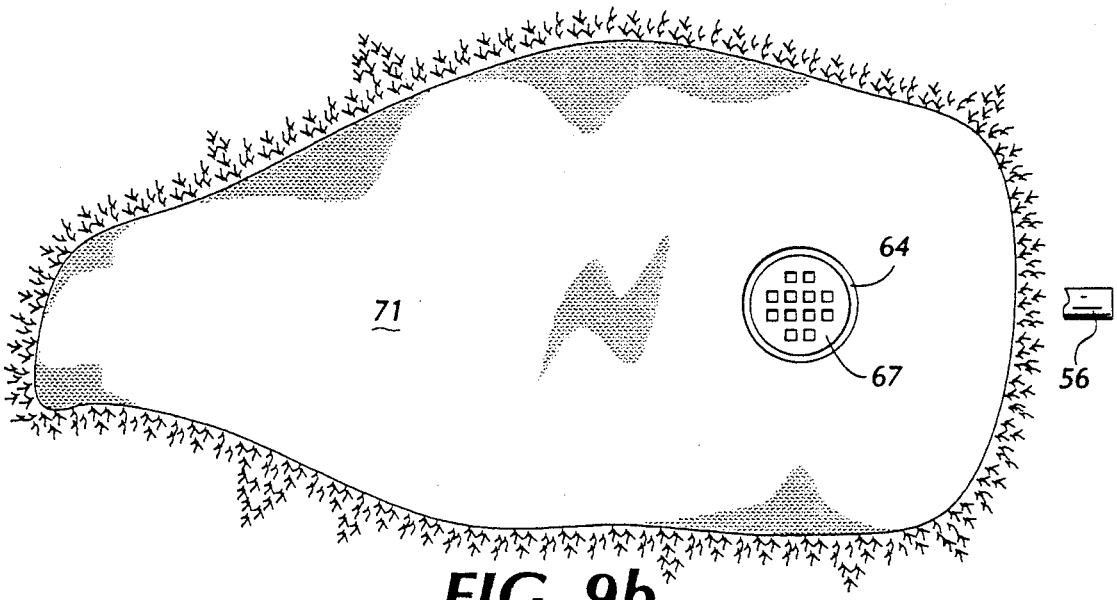

FIGS. 9*a* and 9*b* illustrate how the embodiment of FIG. 8 functions as a permanent rainwater drainage system after its usefulness as a silt erosion device has ended. The device 51 is seen to be positioned within a now stabilized silt control pond 69. As the device functioned to control silt erosion, the pond 69 slowly filled to the top of cage 53 with silt and dirt 71. When the pond 69 was substantially filled, the silt and dirt 71 was graded, leveled, and stabilized against further erosion by means of grass 72 or other suitable stabilizing media.

With the pond filled and stabilized, the sleeve 57 (not visible in FIG. 9*a*) was inserted into the cage 53 and the lid 64 and grate 67 were appropriately positioned atop the sleeve. As seen in FIG. 9*b*, this leaves only the grate 67 and a portion of the lid 64 visible on the top of the finished land. With this embodiment of the invention in place, future rainwater draining to the location of the pond passes through the grate 67, into the sleeve 57, and is directed to a remote location through the conduit 56. The invention thus functions not only as a silt control device but converts to a permanent rainwater drainage system after its usefulness as a silt control device has ended.

Figure 10:
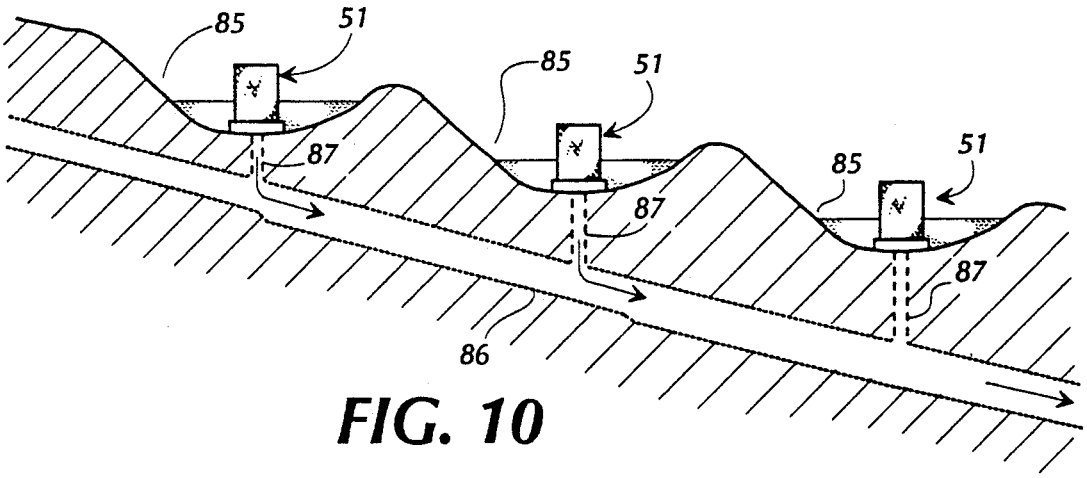
FIG. 10 illustrates use of the present invention for controlling silt erosion on an extended sloped grade.

FIG. 10 illustrates use of the embodiment shown in FIG. 8 along an extended sloped grade of land where silt erosion must be controlled. When used in this manner, a series of silt collection ponds 85 are formed successively down the grade. A subterranean drain pipe 86 extends beneath the successive ponds 85 and each pond is equipped with an erosion control device 51 as described hereinabove. Each of the devices 51 communicates with the subterranean drain pipe 86 through a respective conduit 87. Preferably, the subterranean drain pipe 86 is configured with successively larger diameters extending down the slope so as to accommodate the successfully larger volumes of water introduced to the drain pipe at each successive stage along the slope.

With the embodiment of FIG. 10, each of the ponds 85 functions as described above to control silt erosion from land above the pond. Unlike prior art systems, however, water collected from each of the silt erosion ponds is delivered directly to the subterranean drain pipe 86 and does not flow further down the hill to successively lower ponds. An accumulation of water flow down the hill and thus the torrent at the bottom often experienced with prior art devices is effectively eliminated since water from each stage of the system is delivered directly to a subterranean drain pipe for delivery to a drainage ditch or river. Silt erosion along the length of the slope is therefore effectively controlled. When each of the silt collecting ponds has filled with silt and dirt, the slope can be graded, leveled, and stabilized in the usual way and each of the devices 51 can be converted to a permanent drain as described above for draining rainwater and thus preventing future erosion.

OPERATION

Figure 2:
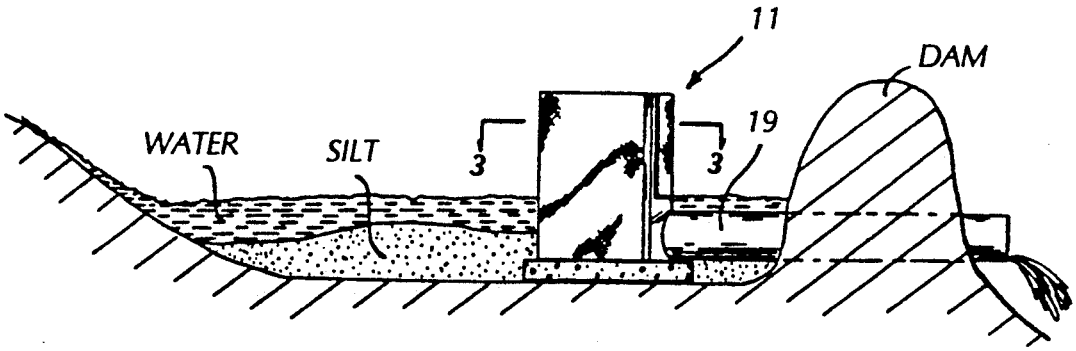
FIG. 2 is a partially sectioned side elevation showing the function of the apparatus in conjunction with a silt collecting pond to control silt erosion according to the method of this invention.
Figure 3:
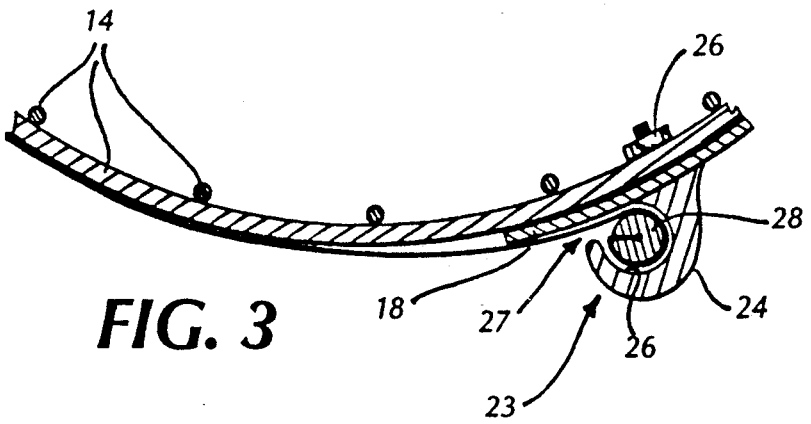
FIG. 3 is a partial cross-sectional view taken along line 3—3 of FIG. 2 showing the silt cloth tensioning means.

As illustrated in FIG. 2, the erosion control apparatus 11 of the present invention is used in conjunction with a silt collecting pond of the type typically formed by construction of a dam on a lower elevation of land subject to erosion. The apparatus 11 is positioned within the pond as shown with the base 12 resting on the bottom of the pond and the silt cloth wrapped cage extending upwardly from the base. While the cage can be mounted to the base in a number of conventional ways, in a preferred embodiment the base is formed of concrete and the cage is simply embedded within the concrete at the time it is poured. The discharge conduit 19 extends from the interior of the cage through a wall of the dam to a position outside the silt collecting pond and preferably delivers water directly to a drainage ditch or river.

If desired, the silt cloth can be mounted to the cage after the cage is placed within the pond by securing a first end of a length of silt cloth to the mounting plate with the attaching strips 22. The silt cloth is then wrapped around the cage and the other end secured to the tensioning rod 28 (FIG. 4) which in turn is inserted into the central bore 26 of the retaining member 24 until the pawl 32 engages the ratchet teeth 31. A large screwdriver or other similar device is then placed within the groove 34 and rotated in a clockwise direction in FIG. 5. This causes the silt cloth to be wrapped about the tensioning rod within the central bore of the retaining member until the silt cloth is drawn tightly about the cage. When the desired tension has been achieved, the screwdriver is removed and the pawl 32 engages the ratchet teeth 31 to maintain the silt cloth in its tightly drawn configuration. The projections 37 formed in the rim 36 tend to engage and partially penetrate the top portion of the silt cloth so that the silt cloth does not sag at the top of the cage as water rises and falls within the silt collecting pond.

As silt bearing rainwater is washed from the land into the silt collecting pond, the water level in the pond rises and water begins to flow through the silt cloth, into the interior volume defined by the cage, and out of the pond through the conduit 19. The mesh size of the silt cloth is preselected to permit water to stand within the pond a sufficient time to allow silt to precipitate to the bottom of the pond as water passes through the silt cloth. In this way, the silt cloth functions not as a filter but rather as a flow regulator so that the silt cloth does not tend to become clogged by silt or other debris. Eventually, most of the water flows out of the pond leaving the dry silt in the bottom of the pond. Layer after layer of silt is thus built up in the pond until the silt level is substantially equal to the depth of the pond, at which time the pond can be cleaned if further erosion control is needed or the collected silt and dirt can be graded, leveled, and stabilized with growing grass or the like if desired.

In the embodiment of FIG. 7, the floatable lid 39 normally rests over the top of the apparatus covering the interior volume to provide a safety closure. Upon exceptionally heavy rainfall when the water level rises above the top of the cage, the floatable lid floats on the surface of the water and moves upwardly to open up the interior volume and allow excess water to flow into the top of the cage and out of the pond through the conduit. As the water level recedes, the track followers 42 slide downwardly in the tracks 44 and the lid moves downwardly again partially under the influence of the weight 43 to cover the cage. The stops 46 are positioned to engage the underside of the rim 38 upon full extension of the track followers 42 to prevent the track followers from moving out of the tracks 44 in the event of an abnormally severe flood.

The embodiment of FIGS. 8 and 9 are intended for use in circumstances where the filled silt collecting pond is to be finished and planted with grass to become part of the lot or parcel on which it is located. Since such collecting ponds are usually located at the lowest elevation of the lot, a permanent drainage system is needed to prevent unwanted collection of standing water.

After the silt pond has been filled, graded, and stabilized, the concrete sleeve 57 is slid into the cage 53 and the lid 64 and grate 67 is placed atop the sleeve. The soil immediately adjacent the lid and grate can then be finished off and planted with grass so that only the lid and grate are visible. During future rainfalls, then, water flows from the lot to the grate where it enters the interior of sleeve 57 and is delivered safely to a drainage location through conduit 56. The apparatus of this invention thus functions as a permanent drainage system after its usefulness as a silt control device has ceased. Further, the man-hole structure created by the sleeve 57 provides easy access to the drain for repair or cleaning thus ensuring a long and useful life for the system.

In the method illustrated in FIG. 10, a number of silt collecting ponds each having a device of this invention are arranged down a long hill or sloped grade. Each device is coupled to a subterranean drain pipe. With this embodiment, each pond collects silt from a section of the hill and water from that section is delivered directly to the drain pipe, which preferably terminates at a remote drainage ditch or river. In this way, destructive torrents of water at the bottom of the hill are eliminated and silt erosion is controlled effectively all along the hill.

The invention has been described above in terms of preferred embodiments and methodologies. It will be obvious to those of skill in the art, however, that many modifications, deletions, and additions could be made to the illustrative embodiments within the scope of this invention. The cage, for example, could be formed to define shapes other than a cylinder, flexible type hose could be used in place of the conduit, and alternate means for securing the silt cloth to the cage might be chosen. These and other modifications might well be made to the invention without departing from the spirit and scope of the invention as set forth in the claims.

I claim:

1. An apparatus for use in conjunction with a silt collecting pond to control rainwater erosion of silt from adjacent land, said apparatus comprising:

a base member adapted to rest on the bottom of the silt collecting pond;

a support frame mounted to said base member and extending upwardly therefrom with said support frame defining an upwardly open interior volume of said apparatus;

control means positioned about said support frame with said control means being adapted to pass water into said interior volume at a predetermined rate while preventing passage of silt into said interior volume, said predetermined rate being selected to permit water to stand in the silt collecting pond a sufficient time for silt to precipitate to the bottom of the pond;

means adapted to direct water from said interior volume to a location outside of the silt collecting pond;

closure means movably mounted to said support frame with said closure means having a first position closing said upwardly open interior volume and a second position displaced from and opening up said interior volume; and means for moving said closure means from said first position to said second position in response to an increase in water level within the silt collecting pond beyond a predetermined level, whereby upon flow of silt bearing rainwater from adjacent land into the silt collecting pond, silt precipitates to the bottom of the pond and silt free water flows through said control means into said interior volume and is directed out of the pond and whereby said closure means opens up the top of said interior volume in response to flood conditions to permit rapid egress of water from the silt collecting pond.

2. The apparatus of claim 1 wherein said support frame comprises a substantially cylindrical vertically oriented cage formed by interconnected rods and wherein said control means comprises a length of silt cloth stretched about the exterior of said cage.

3. The apparatus of claim 2 further comprising tensioning means for drawing said length of silt cloth tightly about the exterior of said cage and maintaining said silt cloth in its tightly drawn configuration.

4. The apparatus of claim 3 wherein said tensioning means comprises:

an elongated retaining member mounted to said cage exterior and extending substantially longitudinally relative to said cage; said retaining member defining a central bore and a longitudinally extending slit in communication with said central bore along the length of said retaining member;

an elongated tensioning rod having a diameter less than the diameter of said central bore and having means for holding an end portion of said length of silt cloth;

said tensioning rod being positioned within said central bore holding a first end portion of said length of silt cloth with the silt cloth extending through said longitudinally extending slit, around the exterior of the cage, and being attached along a second end portion to said cage adjacent said retaining member;

a ratchet mounted to an upper portion of said tensioning rod adjacent a top portion of said retaining means with said ratchet extending radially outwardly from said tensioning rod to define a plurality of teeth; and a pawl movably mounted to the top portion of said retaining means and adapted to engage said ratchet teeth to allow rotation of said tensioning rod in a first direction while preventing rotation thereof in a second direction;

whereby said first end portion of said length of silt cloth wraps about said tensioning rod within said bore upon rotation of said tensioning rod in said first direction thereby drawing said length of silt cloth tightly about the exterior of the cage and said pawl engages said ratchet teeth to prevent rotation of said tensioning rod in said second direction thereby maintaining said length of silt cloth in its tightly drawn configuration about said cage.

5. The apparatus of claim 2 wherein said closure means comprises a substantially disk shaped floatable lid sized to cover the open top of said interior volume defined by said cage with the peripheral portion of said lid having a plurality of elongated track followers extending downwardly therefrom and wherein said cage includes a plurality of vertically oriented tracks mounted thereto in sliding cooperation with said track followers, whereby said floatable lid floats above said cage with said track followers sliding upwardly within said tracks in response to an increase in water level above the top of the cage thereby allowing excess water to spill into said interior volume.

6. The apparatus of claim 5 further comprising weight means mounted to the lower portions of said track followers to urge said lid downwardly upon a decrease in water level below the top of the cage and stop means mounted to the lower portions of said track followers for preventing vertical movement of said track followers out of sliding cooperation with said tracks.

7. The apparatus of claim 2 further comprising means for retaining the upper portion of said slit cloth in place adjacent the upper portion of said cage, said means comprising a rim mounted to said cage upper portion surrounding said cage, said rim having a plurality of protrusions extending outwardly therefrom and adapted to engage and partially penetrate the upper portion of said slit cloth upon the slit cloth being drawn about said cage.

8. An apparatus for use in conjunction with a silt collecting pond to prevent silt from being washed by rainwater from land surrounding the collecting pond and for providing permanent rainwater drainage from the land after the silt collecting pond has filled with collected silt, said apparatus comprising:

a vertically extending upwardly open cage positionable within the collecting pond with the cage defining an interior volume;

control means on said cage with said control means being adapted to pass water into said interior volume at a predetermined flow rate while preventing passage of silt into said interior volume;

drain means communicating between said interior volume and a remote location outside of the silt collecting pond for draining water from the interior volume;

a sleeve having a shape corresponding substantially to the shape of said cage and being sized to be positioned in and to fit snuggly within said cage; and grate means on the top of said sleeve for permitting ingress of water into the sleeve when the sleeve is in position within said cage;

whereby silt bearing water flows into the collecting pond where the silt precipitates to and collects on the bottom of the pond while the water flows into the interior volume of the cage and is drained away from the pond and when the pond has filled with collected silt, the sleeve can be slid into position within the cage thus creating a permanent drain for collecting rainwater and directing it away from the filled silt pond.

9. The apparatus of claim 8 and wherein said cage is substantially cylindrical.

10. The apparatus of claim 8 and wherein said control means comprises a sheet of silt cloth wrapped about the exterior of said cage with said silt cloth having a mesh size chosen to allow water to flow into said cage at a predetermined rate selected to allow water to stand in the collecting pond a time sufficient for silt to precipitate to the bottom of the pond.

* * * * *